US006405886B1

(12) United States Patent
Gearhart et al.

(10) Patent No.: US 6,405,886 B1
(45) Date of Patent: Jun. 18, 2002

(54) CLOSURE HAVING A TAMPER INDICATING BAND

(75) Inventors: Kent Gearhart, Newburgh; Christopher Clodfelter, Evansville, both of IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/779,786

(22) Filed: Feb. 8, 2001

(51) Int. Cl.[7] ..... B65D 41/34
(52) U.S. Cl. ..... 215/252
(58) Field of Search ..... 215/252

(56) References Cited

U.S. PATENT DOCUMENTS 4,496,302 A 1/1985 Brown
4,552,328 A 11/1985 Dutt et al.
4,657,153 A * 4/1987 Hayes ..... 215/252
4,767,587 A 8/1988 Towns et al.
4,807,771 A * 2/1989 Roy et al. ..... 215/252
4,978,016 A 12/1990 Hayes
4,981,230 A 1/1991 Marshall et al.
5,007,545 A * 4/1991 Imbery, Jr. ..... 215/252
5,230,856 A 7/1993 Schellenbach
5,281,385 A 1/1994 Julian
5,565,223 A 10/1996 McCready et al.
5,611,446 A 3/1997 Ingram et al.
5,749,484 A * 5/1998 Trout ..... 215/252
5,755,346 A * 5/1998 Ekkert ..... 215/252
5,833,912 A 11/1998 Schweigert et al.
6,328,175 B2 * 12/2001 Champagnon et al. ..... 215/252

* cited by examiner

*Primary Examiner*—Nathan J Newhouse
(74) *Attorney, Agent, or Firm*—Charles G. Lamb; Middleton Reutlinger

(57) ABSTRACT

A closure for a container is provided with a tamper indicating band attached to a lower terminating end of a skirt wherein the tamper indicating band is provided with an outer surface of varying diameters from the attaching point of the tamper indicating band to the skirt and the lower terminating end of the tamper indicating band. A plurality of folding fingers are hingedly connected to the retaining band terminating end and the thicknesses of the folding fingers increase from the connection of the folding fingers to the lower retaining end to a preselected position of the folding fingers.

7 Claims, 3 Drawing Sheets

CLOSURE HAVING A TAMPER INDICATING BAND

BACKGROUND OF THE INVENTION

This invention relates to a closure for a container having a tamper indicating band and more particularly to a closure for a container having a tamper indicating band with a decreasing outer surface diameter.

It has become common practice in packaging containers to have a closure on the container with a tamper indicating band attached to a lower portion of the closure wherein the tampering indicating band is retained on the container upon the first removal of the closure from the container. The tamper indicating band is generally connected by a broken line which is defined by a plurality of bridges and spaces circumscribing the container and connecting the tamper indicating band to a lower terminating end of a skirt for the closure. Upon the first removal of the closure from the container, the band is severed along the bridge portions to indicate that the closure has been tampered with.

There have been a number of tamper indicating closures on packages and particularly tamper indicating bands attached to the lower edges of closure skirts. Moreover, there are a number of references in the prior art which teach tamper indicating bands with folding fingers at their lower terminating ends which engage the neck of a container and assist in maintaining the tamper indicating band on the container. For example, U.S. Pat. Nos. 4,488,655; 4,506,795; and U.K. Patent Application No. 2,033,350 all teach tamper indicating bands having folding fingers with these bands being attached to the lower edge of closure skirts.

SUMMARY OF THE INVENTION

It is an object of the present invention to provide a tamper indicting band for a closure for a container having flexible finger portions for engagement with a retaining bead of a container.

It is another object of the present invention to provide a closure for a container having a tamper indicating band having an outer surface of a greater diameter at an upper portion than at a lower portion.

It is a further object of the present invention to provide a closure for a container which is easily removable from a molding core of ever decreasing outer surface diameter from top to bottom so the molded part falls free out of a stripper ring on removal from a mold core.

More particularly, the present invention provides a closure for a container having a top wall with a skirt circumscribing the top wall and extending downwardly therefrom. The skirt is provided with a skirt lower terminating end of a first outer diameter. A tamper indicating band extends downwardly from the skirt lower terminating end and the tamper indicating band has an upper band portion of a second outer diameter and a lower retaining band portion of a third outer diameter, the upper band and the lower retaining band being separated by a frangible connection. The lower retaining band has a retaining band terminating end with a plurality of folding fingers extending downwardly therefrom. The folding fingers have upper fingers end of a fourth outer diameter and a lower fingers end of a fifth outer diameter. The first outer diameter is greater than the second outer diameter, the second outer diameter is greater than the third outer diameter, the third outer diameter is greater than the fourth outer diameter and the fourth outer diameter is greater than the fifth outer diameter.

A more comprehensive understanding of the invention can be obtained by considering the detailed description set forth hereinafter and the accompanying figures.

DETAILED DESCRIPTION OF THE PREFERRED EMBODIMENT

Figure 2:
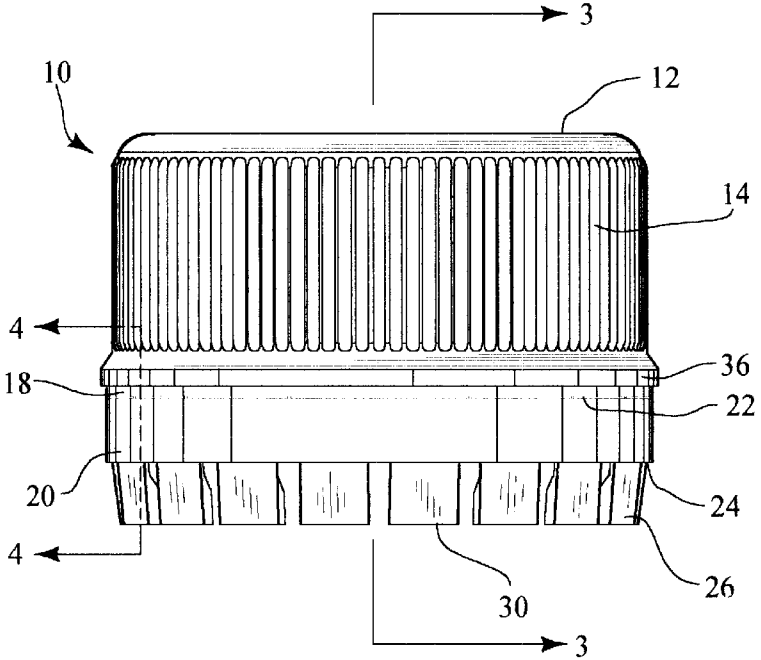
FIG. 2 is a side view of the closure of FIG. 1.
Figure 1:
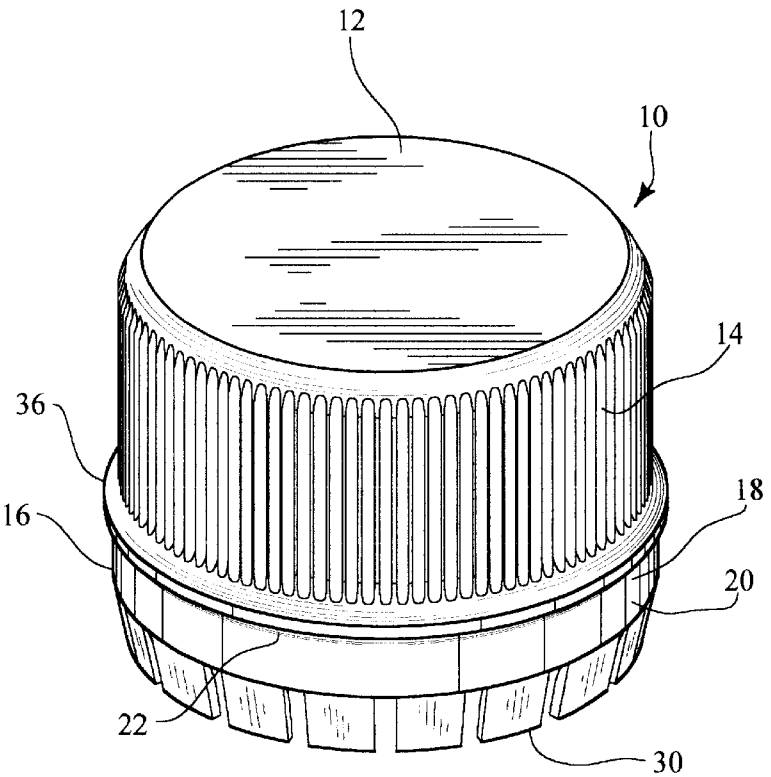
FIG. 1 is a perspective view of a closure in an as molded condition, of the present invention.

In FIGS. 1–4 is shown a closure 10 having a top wall 12 with a downwardly extending skirt 14 circumscribing the top wall 12 in an as molded condition. Attached to the lower terminating end of the skirt 14 is a tamper indicating band 16. The tamper indicating band 16 includes an upper band portion 18 which is separated from a lower retaining band portion 20 by a frangible connection 22. The lower retaining band 20 is provided with a retaining band terminating end 24 to which a plurality of folding fingers 26 are attached thereto. Folding fingers 26 are provided with terminating finger ends 30 whereby in a use condition the folding fingers 26 are folded inwardly and upwardly, as shown in FIG. 5, to engage a retaining bead (not shown) of a lower portion of a neck of a container. Moreover, the closure 10 is provided with an inner surface 34 with threads 32 for engagement with outer mating threads of a container neck (not shown). Also, at the terminating end of the skirt 14 circumscribing the outer surface thereof is a flange 36.

Figure 4:
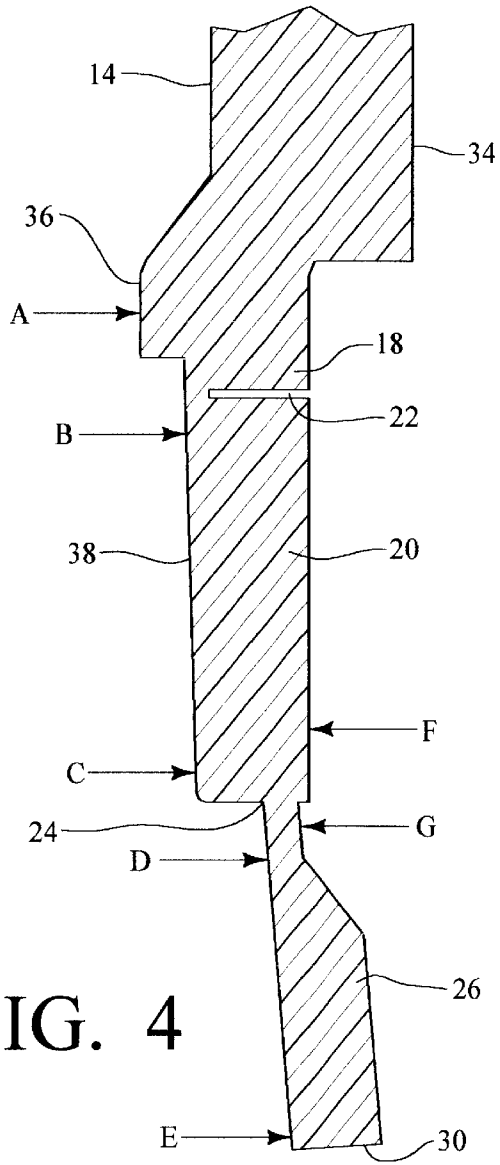
FIG. 4 is an enlarged sectional detail view of the tamper indicating band and folding fingers of FIG. 3; and, FIG. 5 is the sectional view of FIG. 3 shown in a use condition.
Figure 3:
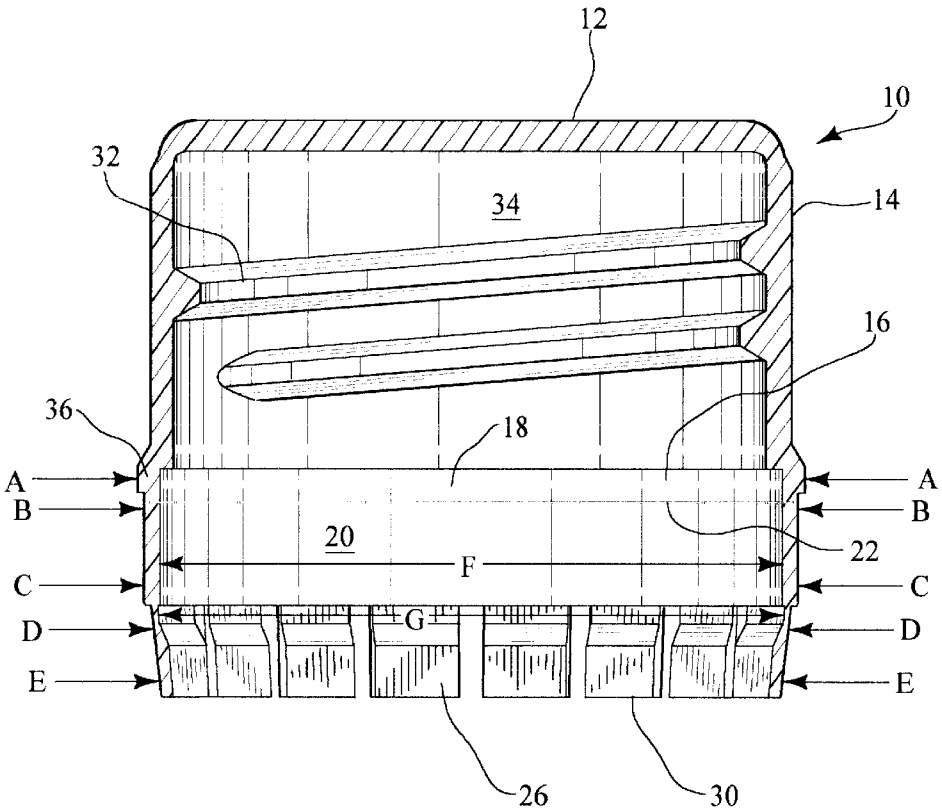
FIG. 3 is a sectional view taken along line 3—3 of FIG. 2.
Figure 5:
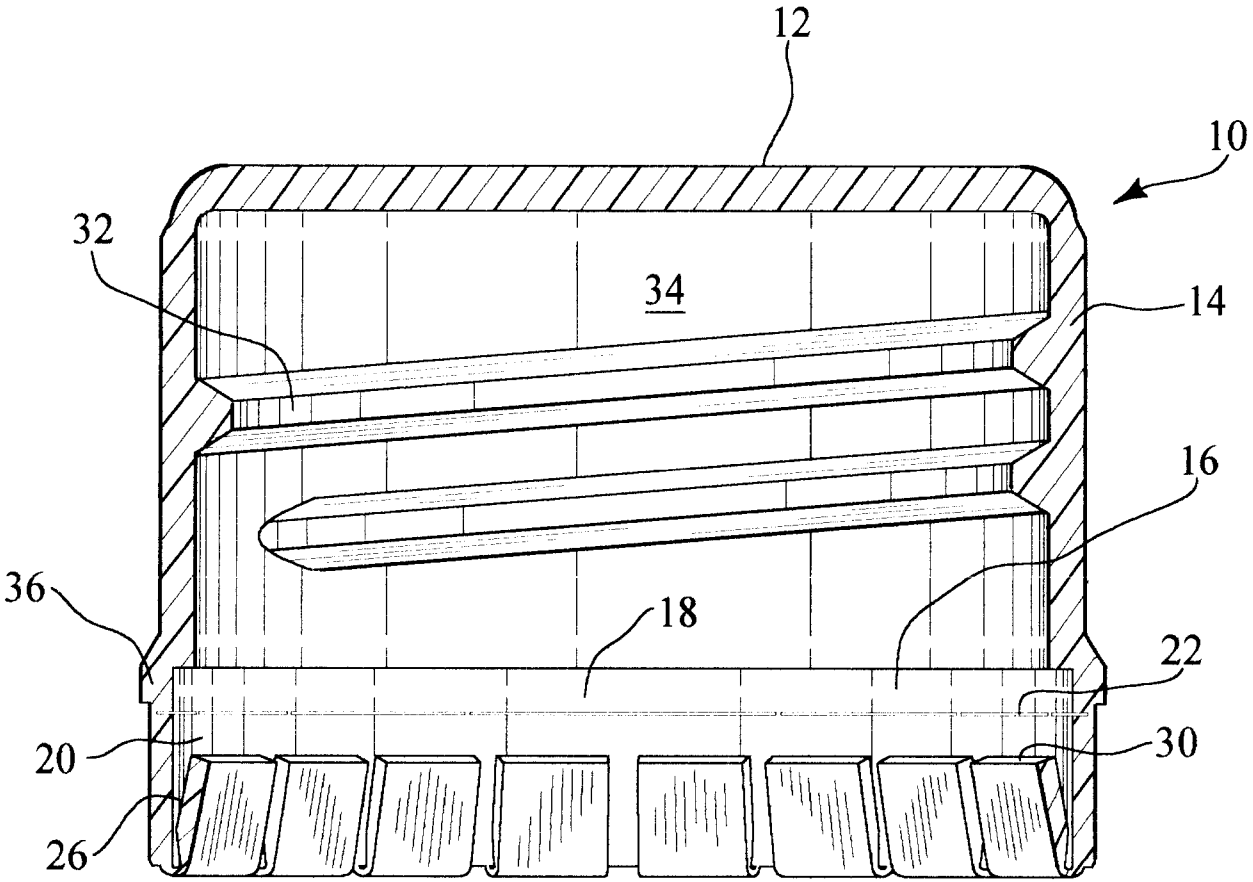

As best shown in FIGS. 3 and 4, the closure 10 has a constant decreasing outer surface diameter from the flange or skirt lower terminating end 36 to the terminating end 30 of the folding fingers 26. Particularly, the lower terminating end 36 of the skirt 14 has a first outer diameter as indicated at "A"; the upper band 18 of the tampering indicating band 16 has a second outer diameter as indicated at "B"; the lower retaining band 20 has a third outer diameter as indicated at "C"; the upper end of the folding fingers 26 has a fourth outer diameter as indicated at "D"; and, the lower terminating end 30 of the fingers 26 has a fifth outer diameter as indicated at "E". As shown, the first outer diameter "A is greater than the second outer diameter "B", the second outer diameter "B" is greater than the third outer diameter "C", the third outer diameter "C" is greater than the fourth outer diameter "D" and the fourth outer diameter "D" is greater than the fifth outer diameter "E".

Also, the inner diameter of the first fingers end of the folding fingers 26 has a first inner diameter "G" which is greater than a second inner diameter of the lower retaining band 20 as noted at "F". Moreover, folding fingers 26 are relatively thin at their points of attachments so the folding fingers may swing inwardly to contact the side of a container neck and engage with a retaining bead. Furthermore, these hinge connections also allow for the folding fingers to flex outward during the molding process. And, the thicknesses of the folding fingers increase from the connection of the folding fingers 26 to the lower retaining band 20 to a preselected position of the folding fingers 26.

In the manufacture of these closures, because of the design of the side walls being an ever decreasing outer diameter from the lower edge of the closure skirt to the lower edges of the folding fingers, this allows for easy removal of the closure from a stripper ring after molding.

The foregoing detailed description is given primarily for clearness of understanding and no unnecessary limitations are to be understood therefrom for modifications will become obvious to those skilled in the art upon reading this closure and may be made without departing from the spirit of the invention and the scope of the appended claims.

What is claimed is:

1. A closure for a container comprising:

a top wall;

a skirt circumscribing said top wall and extending downwardly therefrom, said skirt having a skirt lower terminating end of a first outer diameter;

a tamper indicating band extending from said skirt lower terminating end, said tamper indicating band having an upper band of a second outer diameter and a lower retaining band of a third outer diameter, said upper band and said lower band being separated by a frangible connection, said lower retaining band having a retaining band terminating end;

a plurality of folding fingers extending from said retaining band terminating end, said folding fingers having a first fingers end of a fourth outer diameter and a second fingers end of a fifth outer diameter;

said first outer diameter being greater than said second outer diameter, said second outer diameter being greater than said third outer diameter, said third outer diameter being greater than said fourth outer diameter, and, said fourth outer diameter being greater than said fifth outer diameter.

2. The closure of claim 1, said skirt having threads along an inner surface thereof.

3. The closure of claim 1, said skirt terminating end having an outwardly extending flange portion.

4. The closure of claim 1, said lower retaining band having a first inner diameter and said first fingers end having a second inner diameter, said second inner diameter being greater than said first inner diameter.

5. The closure of claim 1 having a constant decreasing outer surface diameter from said skirt lower terminating end to said second fingers end.

6. The closure of claim 1, said folding fingers being hingedly attached to said retaining band terminating end.

7. The closure of claim 1 wherein said folding fingers are of increasing thickness from said retaining band terminating end to a preselected position of said folding fingers.

* * * * *